US009013519B2

(12) United States Patent
Park et al.

(10) Patent No.: US 9,013,519 B2
(45) Date of Patent: Apr. 21, 2015

(54) ORGANIC LIGHT EMITTING DISPLAY AND METHOD OF DRIVING THE SAME

(75) Inventors: Jung-Kook Park, Yongin (KR); Jae-Yong Kim, Yongin (KR); Byung-Hoon Chae, Yongin (KR); Si-Baek Pyo, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 217 days.

(21) Appl. No.: 13/616,352

(22) Filed: Sep. 14, 2012

(65) Prior Publication Data

US 2013/0194316 A1 Aug. 1, 2013

(30) Foreign Application Priority Data

Jan. 26, 2012 (KR) ..... 10-2012-0007950

(51) Int. Cl.
*G09G 5/10* (2006.01)
*G09G 3/32* (2006.01)

(52) U.S. Cl.
CPC ..... *G09G 3/3225* (2013.01); *G09G 3/3291* (2013.01); *G09G 2320/0238* (2013.01); *G09G 2320/0673* (2013.01); *G09G 2330/021* (2013.01); *G09G 2360/16* (2013.01)

(58) Field of Classification Search
USPC ..... 345/204, 589, 690, 691
See application file for complete search history.

(56) References Cited

U.S. PATENT DOCUMENTS

| | | | | |
|---|---|---|---|---|
| 2005/0195178 | A1* | 9/2005 | Jo et al. | 345/204 |
| 2007/0002073 | A1* | 1/2007 | Baik et al. | 345/589 |
| 2008/0074361 | A1* | 3/2008 | Lee et al. | 345/77 |
| 2009/0189925 | A1* | 7/2009 | Huang et al. | 345/691 |
| 2010/0073339 | A1 | 3/2010 | Lee et al. | |

FOREIGN PATENT DOCUMENTS

| | | | |
|---|---|---|---|
| KR | 10-2005-0007340 | A | 1/2005 |
| KR | 10-2008-0013361 | A | 2/2008 |
| KR | 10-2010-0034584 | A | 4/2010 |

* cited by examiner

*Primary Examiner* — Premal Patel
(74) *Attorney, Agent, or Firm* — Lee & Morse, P.C.

(57) ABSTRACT

There is provided an organic light emitting display capable of improving the display quality of a low brightness region. The organic light emitting display includes pixels positioned at intersections of scan lines, emission control lines, and data lines, a converter for receiving data to generate brightness values, a timing controller for extracting emission time values and gamma values to correspond to the brightness values, an emission control line driver for supplying emission control signals to the emission control lines so that emission times of the pixels are controlled to correspond to the emission time values, and a gamma voltage generator for generating gamma voltages corresponding to the gamma values.

16 Claims, 3 Drawing Sheets

ORGANIC LIGHT EMITTING DISPLAY AND METHOD OF DRIVING THE SAME

CROSS-REFERENCE TO RELATED APPLICATION

This application claims priority to and the benefit of Korean Patent Application No. 10-2012-0007950, filed on Jan. 26, 2012, in the Korean Intellectual Property Office, and entitled: "Organic Light Emitting Display Device and Driving Method Thereof," which is incorporated by reference herein in its entirety.

BACKGROUND

1. Field

Embodiments relate to an organic light emitting display and a method of driving the same, and more particularly, to an organic light emitting display capable of improving the display quality of a low brightness region and a method of driving the same.

2. Description of the Related Art

Recently, various flat panel displays (FPD) capable of reducing weight and volume that are disadvantages of cathode ray tubes (CRT) have been developed. The FPDs include liquid crystal displays (LCD), field emission displays (FED), plasma display panels (PDP), and organic light emitting displays.

Among the FPDs, the organic light emitting displays display images using organic light emitting diodes (OLED) that generate light by re-combination of electrons and holes. The organic light emitting display has high response speed and is driven with low power consumption.

However, the conventional organic light emitting display has a problem in that a spot is observed in the low brightness region. In detail, the organic light emitting display compensates for the threshold voltages of the driving transistors included in pixels as circuit. However, in the low brightness region, the threshold voltages of the driving transistors are not completely compensated for low current, so the spot is observed.

SUMMARY

Accordingly, embodiments are directed to providing an organic light emitting display capable of improving the display quality of a low brightness region and a method of driving the same.

One or more embodiments may provide an organic light emitting display, including pixels positioned at intersections of scan lines, emission control lines, and data lines, a converter for receiving data to generate brightness values, a timing controller for extracting emission time values and gamma values to correspond to the brightness values, an emission control line driver for supplying emission control signals to the emission control lines so that emission times of the pixels are controlled to correspond to the emission time values, and a gamma voltage generator for generating gamma voltages corresponding to the gamma values.

The organic light emitting display may further include a scan driver for supplying scan signals to the scan lines, a data driver for generating data signals using the data and the gamma voltages, a first look-up table for storing the emission time values corresponding to the brightness values, and a second look-up table for storing the gamma values corresponding to the brightness values. The emission time values may be set so that the emission times of the pixels are reduced from high brightness values toward low brightness values. The gamma values may be set so that brightness components corresponding to gray levels of original data are generated by the pixels to correspond to the emission times. The converter may generate the brightness values using data of at least one frame.

One or more embodiments may provide a method of driving an organic light emitting display, including generating brightness values from data, extracting emission time values and gamma values to correspond to the brightness values, controlling widths of emission control signals to correspond to the emission time values, generating gamma voltages corresponding to the gamma values, generating data signals using the gamma voltages and the data, and pixels that receive the data signals emitting light components by times corresponding to the widths of the emission control signals.

The emission time values may be set so that the emission times of the pixels are reduced from high brightness values toward low brightness values. The gamma values may be set so that brightness components corresponding to gray levels of original data are generated by the pixels to correspond to the emission times. In generating the brightness values, the brightness values may be generated using data of at least one frame.

BRIEF DESCRIPTION OF THE DRAWINGS

Features will become apparent to those of ordinary skill in the art by describing in detail exemplary embodiments with reference to the attached drawings in which.

DETAILED DESCRIPTION

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

Figure 1:
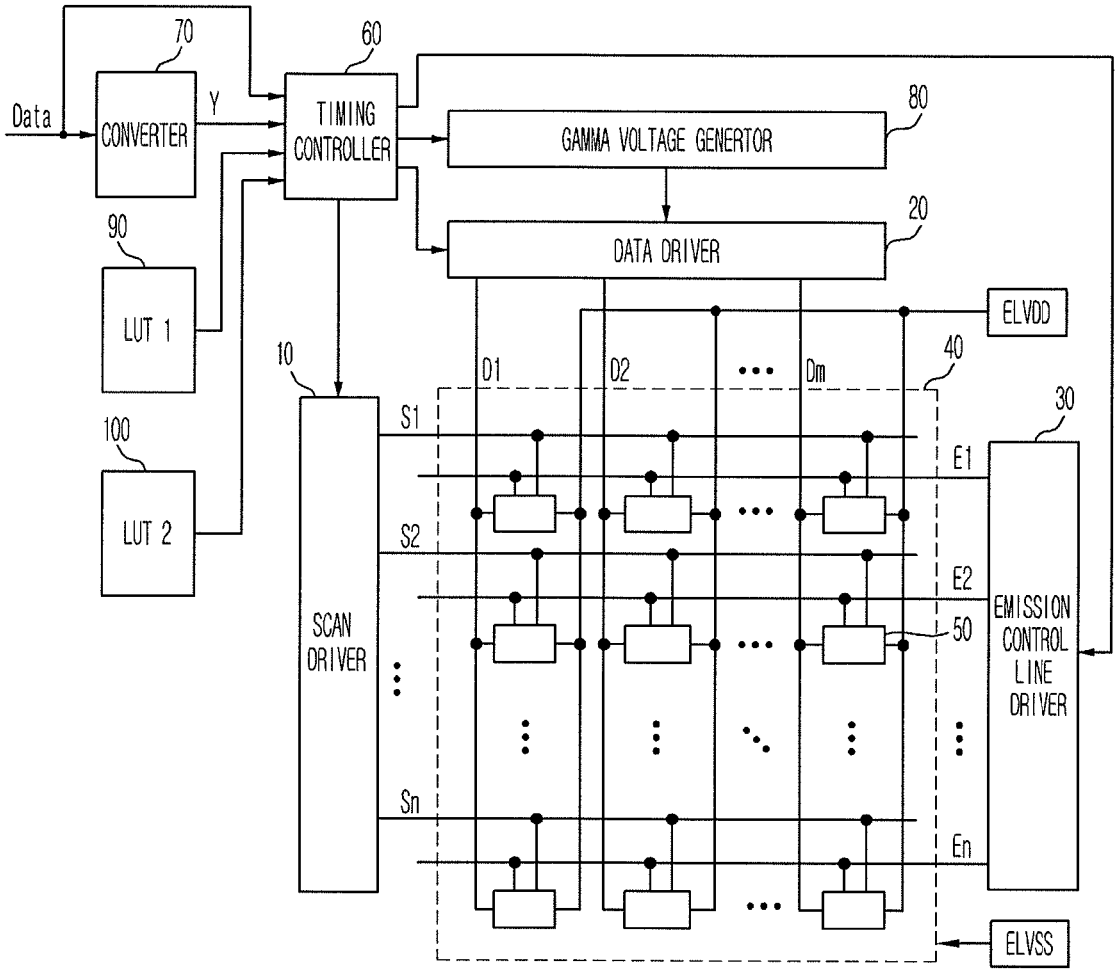
FIG. 1 is a view illustrating an organic light emitting display according to an embodiment of the present invention.

FIG. 1 is a view illustrating an organic light emitting display according to an embodiment.

Referring to FIG. 1, the organic light emitting display according to the present embodiment includes a pixel unit 40 including pixels 50 positioned at the intersections of scan lines S1 to Sn, data lines D1 to Dm, and emission control lines E1 to En, a scan driver 10 for driving the scan lines S1 to Sn, a data driver 20 for driving the data lines D1 to Dm, an emission control line driver 30 for driving the emission control lines E1 to En, and a gamma voltage generator 80 for generating a gamma voltage.

In addition, the organic light emitting display according to the present embodiment includes a converter 70 for converting data Data into brightness values Y, a first look-up table LUT1 90 for storing information on the emission times of the pixels 50 corresponding to the brightness values Y, a second look-up table LUT2 100 for storing the gamma values corresponding to the brightness values Y, and a timing controller 60 for controlling the scan driver 10, the data driver 20, the emission control line driver 30, and the gamma voltage generator 80.

The scan driver 10 sequentially supplies scan signals to the scan lines Si to Sn to correspond to the control of the timing controller 60. When the scan signals are sequentially supplied to the scan lines S1 to Sn, the pixels 50 are selected in units of lines. Therefore, the scan signals are set as voltages by which the transistors included in the pixels 50 may be turned on.

The data driver 20 receives data from the timing controller 60 and receives gamma voltages from the gamma voltage generator 80. The data driver 20 that receives the data selects the gamma voltages corresponding to the gray levels of the data to generate data signals and supplies the generated data signals to the data lines D1 to Dm in synchronization with the scan signals. The data signals supplied to the data lines D1 to Dm are supplied to the pixels 50 selected by the scan signals.

The emission control line driver 30 sequentially supplies emission control signals to the emission control lines E1 to En. The pixels 50 that receive the emission control signals are set to be in a non-emission state in the period where the emission control signals are supplied. Therefore, the emission control signals are set as voltages by which the transistors included in the pixels 50 may be turned off. The emission control line driver 30 controls the width of the emission control signals in units of frames to correspond to the control of the timing controller 60.

The converter 70 generates the brightness values Y using the data Data. For example, the converter 70 may generate the brightness values Y from the data Data using EQUATION 1.

$$Y=Kr\times R+Kg\times G+Kb\times B \quad \text{[EQUATION 1]}$$

In EQUATION 1, Kr, Kg, and Kb are constants, and R, G, and B are red data, green data, and blue data, respectively. Kr, Kg, and Kb may vary to correspond to the brightness distributions of the red, green, and blue data, respectively. For example, Kr, Kg, and Kb may be set as 0.2, 0.7, and 0.1, respectively.

The converter 70 extracts the brightness value Y of at least one frame and supplies the extracted brightness value Y to the timing controller 60. For example, the converter 70 extracts the brightness values Y corresponding to the data Data of one frame or two frames to supply the extracted brightness values Y to the timing controller 60.

Figure 2:
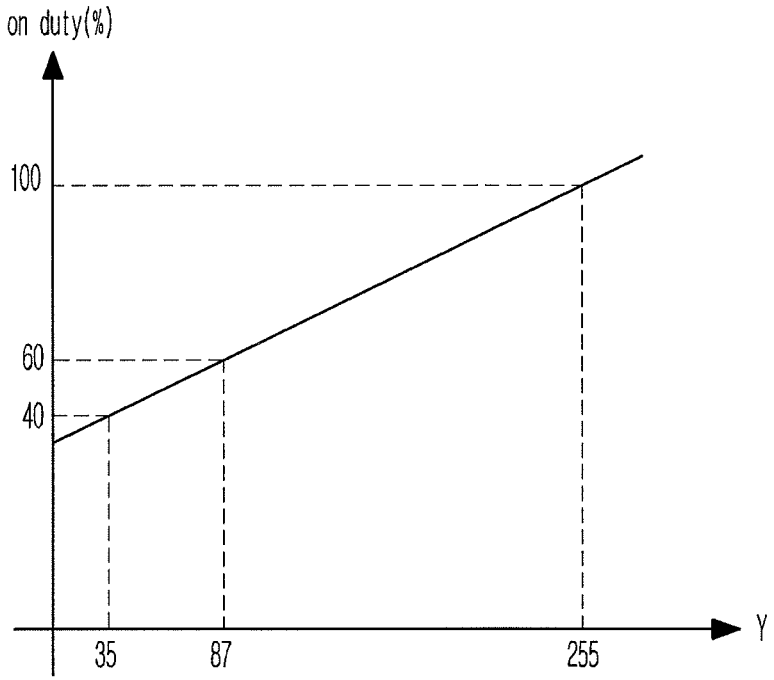
FIG. 2 is a view illustrating the emission times corresponding to the brightness values stored in the first lookup table illustrated in FIG. 1.

As illustrated in FIG. 2, the emission time values corresponding to the brightness values Y are stored in the LUT1 90. In FIG. 2, the X axis represents the brightness values Y and the Y axis represents emission times (on duty).

The emission time values stored in the LUT1 90 are set so that the emission times are reduced as the brightness values Y decreases. For example, the emission time may be set as 100% when the brightness value Y is 255 (full white), the emission time may be set as 60% when the brightness value Y is 87, and the emission time may be set as 40% when the brightness value Y is 35. As illustrated in FIG. 2, a minimum on duty cycle may be set, e.g., at 35%.

The gamma values corresponding to the brightness values are stored in the LUT2 100. In detail, when the emission time is reduced in the low brightness region like the LUT1 90, brightness is reduced. Therefore, the gamma values stored in the LUT2 100 result in the light components of desired brightness components being generated to correspond to the emission times.

For example, the gamma values are stored in the low brightness region so that the light components of high brightness components may be generated by the reduced emission times. Therefore, desired brightness components may be obtained in the low brightness region. That is, the pixels generate the light components of high brightness components in the low brightness region for a short time so that an observer may stably view a low brightness image.

On the other hand, in the low brightness region (that is, low gray level region), the pixels 50 generate the light components of high brightness components for a short time. When high current flows to the pixels 50, the threshold voltages of the driving transistors are stably compensated for so that it is possible to prevent a spot from being observed in the low brightness region (or low gray level region). In addition, since the emission time is not reduced in a high brightness region, it is possible to stably display an image of desired brightness without increasing the current.

In contrast, if high current is supplied to an entire gray level region, the life of the organic light emitting display is reduced and power consumption is increased.

The timing controller 60 extracts the emission time values from the LUT1 90 to correspond to the brightness values Y and extracts the gamma values from the LUT2 100.

The timing controller 60 that extracts the emission time values from the LUT1 90 controls the emission control line driver 30 so that the widths of the emission control signals may be controlled to correspond to the emission time values. The emission control line driver 30 controls the widths of the emission control signals so that the emission times of the pixels 50 are controlled to correspond to the control of the timing controller 60.

The timing controller 60 that extracts the gamma values from the LUT2 100 supplies the gamma values to the gamma voltage generator 80. The gamma voltage generator 80 that receives the gamma values resets the voltage values corresponding to the gray levels to correspond to the gamma values. In this case, the gamma voltages generated by the gamma voltage generator 80 are set so that desired brightness components (i.e., brightness components corresponding to the gray levels of original data) are generated by the pixels to correspond to the emission times.

Figure 3:
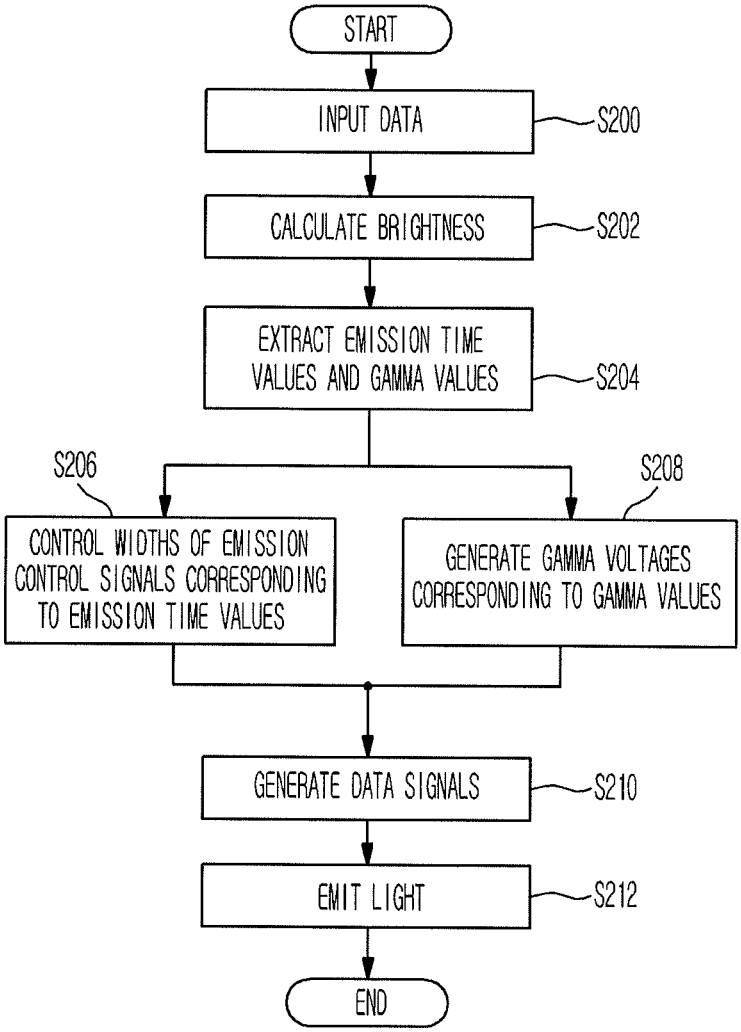
FIG. 3 is a view illustrating a method of driving the organic light emitting display according to the embodiment of the present invention.

FIG. 3 is a view illustrating a method of driving the organic light emitting display according to the present embodiment.

When operation processes are described in detail with reference to FIGS. 1 and 3, the data Data are input from an external system to the converter 70 and the timing controller 60 (S200). The converter 70 that receives the data Data extracts the brightness value Y of at least one frame and supplies the extracted brightness value Y to the timing controller 60 (S202).

The timing controller 60 that receives the brightness values Y extracts the emission time values from the LUT1 90 to correspond to the brightness values Y and extracts the gamma values from the LUT2 100 (S204).

For example, the timing controller 60 extracts the emission time value of 40% when the brightness value Y of 35 is input and extracts the emission time value of 60% when the brightness value Y of 87 is input. The timing controller 60 extracts the gamma value corresponding to the emission time value of 40% from the LUT2 100 so that an image of a desired brightness may be displayed by the pixels to correspond to the emission time of 40% when the brightness value Y of 35 is input.

The timing controller 60 that extracts the emission time values controls the emission control line driver 30 so that the pixels 50 emit for corresponding emission times. Then, the emission control line driver 30 generates the emission control signals having the widths corresponding to the emission time values (S206). In addition, the timing controller 60 that receives the gamma values supplies the gamma values supplied thereto to the gamma voltage generator 80. The gamma voltage generator 80 that receives the gamma values generates the gamma voltages corresponding to the gamma values to supply the generated gamma voltages to the data driver 20 (S208).

On the other hand, the timing controller 60 realigns the data Data supplied thereto to supply the realigned data Data to the data driver 20. The data driver 20 that receives the data Data selects the gamma voltages corresponding to the gray levels of the data Data to generate the data signals (S210).

Then, the pixels 50 are selected by the scan signals supplied from the scan driver 10 to receive the data signals and generate light components of predetermined brightness components to correspond to the received data signals. The emission times of the pixels 50 are determined to correspond to the emission control signals supplied from the emission control line driver 30.

On the other hand, according to the present embodiment, in the period where the brightness value Y of one frame is extracted from the converter 70, the data Data are supplied to the timing controller 60. Therefore, the emission time and the gamma value of the current frame are extracted to correspond to the brightness value Y before one frame. Since image signals do not rapidly change in units of frames, i.e., since the previous frame and the current frame have the same or very similar data, although the emission time and the gamma value of the current frame are controlled by the brightness value Y before one frame, it is possible to stably display an image.

By way of summary and review, the organic light emitting display according to embodiments and the method of driving the same, in the low brightness region, the emission times of the pixels are reduced and the voltages (i.e., gamma voltages) of the data signals are set to be high. In this case, in the low brightness region, the amount of current supplied to the driving transistors is increased so that the threshold voltages of the driving transistors are stably compensated for and display quality may be improved.

In addition, since the emission times of the pixels are reduced in the low brightness region, the total amount of current supplied to the pixels is maintained similar to the conventional art. Therefore, it is possible to improve the display quality without the problems of life and power consumption.

While the above has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display, comprising:

pixels positioned at intersections of scan lines, emission control lines, and data lines;

a scan driver to supply scan signals to the scan lines;

a converter for receiving data to generate brightness values;

a timing controller to determine emission time values and gamma values to correspond to the brightness values;

an emission control line driver for supplying emission control signals to the emission control lines so that emission times of the pixels are controlled to correspond to the emission time values;

a gamma voltage generator for generating gamma voltages corresponding to the gamma values, wherein the emission time values correspond to different widths of the emission control signals;

a data driver to generate data signals using the data and the gamma voltages;

a first look-up table to store the emission time values corresponding to the brightness values; and a second look-up table to store the gamma values corresponding to the brightness values.

2. The organic light emitting display as claimed in claim 1, wherein the emission time values are set so that the emission times of the pixels decrease as brightness values decrease.

3. The organic light emitting display as claimed in claim 2, wherein the gamma values are set so that brightness components corresponding to gray levels of original data are generated by the pixels to correspond to the emission times.

4. The organic light emitting display as claimed in claim 1, wherein the converter generates the brightness values using data of at least one frame.

5. The organic light emitting display as claimed in claim 1, wherein the emission time values are set so that the emission times of the pixels decrease as brightness values decrease.

6. A method of driving an organic light emitting display including pixels, the method comprising:

generating brightness values from input data;

determining emission time values and gamma values to correspond to the brightness values;

controlling widths of emission control signals to correspond to the emission time values;

generating gamma voltages corresponding to the gamma values;

generating data signals using the gamma voltages and the data; and supplying pixels with the data signals such that the pixels emit light for a time corresponding to the widths of the emission control signals, wherein the emission time values are set so that the emission times of the pixels decrease as brightness decreases, and wherein the gamma values are set so that brightness components corresponding to gray levels of original data are generated by the pixels to correspond to the emission times.

7. The method as claimed in claim 6, wherein, in generating the brightness values, the brightness values are generated using data of at least one frame.

8. An apparatus, comprising:

an input to receive a first signal; and a controller to determine first and second values based on the first signal, and to generate at least a second signal for controlling display of an image on a display device, wherein the first value is an emission time value and the second value is a gamma value, wherein the gamma value determined by the controller is based on the emission time value; and wherein the gamma value is inversely proportional to the emission time value.

9. The apparatus as claimed in claim 8, wherein:

the gamma value corresponds to a first brightness range when the emission time value is in a first time range, and the gamma value corresponds to a second brightness range when the emission time value is in a second time range, wherein the first brightness range corresponds to a lower gray scale range than the second brightness range, and wherein the first time range includes shorter times than the second time range.

10. The apparatus as claimed in claim 8, wherein the first signal includes information indicative of image data or a brightness of image data.

11. The apparatus as claimed in claim 8, wherein the controller includes a converter to convert the image data to brightness information.

12. The apparatus as claimed in claim 8, wherein the controller changes the emission time value for different values of the first signal.

13. The apparatus as claimed in claim 12, wherein changing the emission time value changes a width of an emission control signal.

14. The apparatus as claimed in claim 13, wherein controller changes the gamma value based on the changed emission time value.

15. The apparatus as claimed in claim 8, wherein the emission time value is determined so that an emission time of a pixel decreases as brightness decreases.

16. The apparatus as claimed in claim 8, wherein the controller determines the first and second values from first and second look-up tables, respectively.

* * * * *